US005966858A

United States Patent [19]

Curtis et al.

[11] Patent Number: 5,966,858

[45] Date of Patent: Oct. 19, 1999

[54] BAFFLED MUZZLE BRAKE AND SEAL SYSTEM FOR SUBMERGED GUN OPERATION

[75] Inventors: Clifford M. Curtis, Portsmouth; Gary R. Berlam, Warwick; Ivan N. Kirschner, Portsmouth; Laurence M. Dean, Newport, all of R.I.

[73] Assignee: The United States of America as represented by the Secretary of the Navy, Washington, D.C.

[21] Appl. No.: 09/049,655

[22] Filed: Mar. 23, 1998

[51] Int. Cl.[6] ..... F41A 21/46; F41F 3/10

[52] U.S. Cl. ..... 42/1.14; 89/14.6; 89/5

[58] Field of Search ..... 42/1.14; 89/1.809, 89/1.81, 5, 14.6

[56] References Cited

U.S. PATENT DOCUMENTS

| | | | |
|---|---|---|---|
| 1,186,023 | 6/1916 | Moore | 89/5 |
| 1,271,640 | 7/1918 | Wentling | 89/5 |
| 3,677,132 | 7/1972 | Plenge | 42/1.14 |
| 4,848,210 | 7/1989 | Bissonnette | 89/1.81 |
| 5,208,422 | 5/1993 | Moody | 89/1.809 |

*Primary Examiner*—Stephen M. Johnson
*Attorney, Agent, or Firm*—Michael J. McGowan; James M. Kasischke; Prithvi C. Lall

[57] ABSTRACT

A baffled muzzle brake and seal system for submerged gun operation includes a muzzle brake chamber mounted to the muzzle of a submerged gun barrel. A baffle assembly mounted within the chamber deflects the propellant gasses produced by operation of the gun and sabot fragments into an annular chamber surrounding the baffle assembly while allowing passage of a projectile through the assembly. A valve seal in the muzzle end of the muzzle brake chamber cycles between a fully open condition, to allow passage of the projectile, and a fully closed position, to seal the muzzle brake chamber against the entry of water. At least one pressurized air input allows the muzzle brake chamber to be pressurized when the seal is not in the fully closed position, thereby preventing entry of water. A gas exhaust provides a means for removing propellant gasses from the chamber.

12 Claims, 2 Drawing Sheets

BAFFLED MUZZLE BRAKE AND SEAL SYSTEM FOR SUBMERGED GUN OPERATION

The invention described herein may be manufactured and used by or for the Government of the United States of America for governmental purposes without the payment of any royalties thereon or therefor.

BACKGROUND OF THE INVENTION (1) Field of the Invention

The present invention relates to underwater guns and more specifically, to apparatus for preventing the entry of water into an underwater gun, for capturing a sabot, and for managing the propellant gases produced by firing the gun.

(2) Description of the Prior Art

Various underwater guns have been developed that utilize an explosive charge that must be kept dry and in the presence of air for proper detonation. Generally, such guns have utilized a single-use seal to prevent entry of water into either the gun or into a cartridge containing the explosive charge.

U.S. Pat. No. 3,585,934 discloses a disposable ammunition having a watertight barrel that is removably mounted into a carrier cylinder or block for firing. A head end cap assembly seals the breech end of the barrel and a closure cup seals the muzzle end of the barrel to provide a watertight enclosure. A propellant charge disposed in the barrel is ignited to propel a flechette from the barrel. The closure cup is destroyed as the flechette exits the barrel. Once the ammunition is fired, the barrel is removed and replaced with an unfired ammunition.

U.S. Pat. Nos. 4,651,454 and 4,742,775 each disclose a spear gun having a chamber in its breech for receiving an explosive power load. The power load has a closed end that is adapted to open when the propellant explodes. The closed end is sealed with a sealing compound to prevent the entry of water. Once the power load has been fired, the breech is opened and the spent power load is replaced with a new power load. A plurality of circumferential grooves in the breech end of the spear serve as pressure interrupters or dynamic seals to interfere with and inhibit the escape of the detonation gases within the barrel of the spear gun. Water is free to enter both the barrel and the breech of the spear gun.

It is also well known to provide projectiles in firearms with a sabot surrounding the projectile to enhance the projectile's muzzle velocity. Often this sabot is stripped away from the projectile during launch by the firearm thereby changing the projectile's flight characteristics.

The single use sealing systems of the prior art devices require replacement of the seal each time the underwater gun is fired. The seal is generally a part of a sealed unit such as the power load or ammunition discussed above. Therefore, replacement of the seal requires replacement of a larger structure. Consequently, such apparatus is limited in use to applications that allow access to this sealed unit. In addition, the time required to replace the sealed unit limits the speed at which multiple projectiles may be fired, and the prior art devices are either limited to single shot applications or require the use of multiple sealed units to permit rapid firing of multiple projectiles. Generally, the number of sealed units that can be supported is limited, thereby limiting the total number of projectiles that may be fired. Finally, prior art underwater guns do not control the propellant gasses once the projectile has been launched. The introduction of the propellant gasses into the surrounding water reduces the performance of the projectiles.

SUMMARY OF THE INVENTION

It is a general purpose and object of the present invention to provide an underwater firearm that permits rapid firing of multiple projectiles without requiring replacement of the watertight seal.

It is a further object to provide an underwater firearm that reduces the pressure impulse imparted to the surrounding water by the propellant gasses.

Another object is to strip a sabot from the projectile during launch.

Yet another object is to provide an underwater firearm that captures any sabots that may be used with the projectile.

These objects are accomplished with the present invention by providing a baffled muzzle brake and seal assembly having a housing mounted to the muzzle end of the firearm barrel. The breech end of the housing includes a projectile inlet port and the muzzle end of the housing includes a projectile outlet port that together define a projectile path through the housing. A valve mounted on the muzzle end of the housing has a valve body defining an aperture and a valve seal for selectively closing and opening the aperture. The aperture defines a second projectile path that is coaxial with the housing projectile path and the bore of the barrel. The valve seal is moveable between an open position, where no portion of the seal is in the projectile path, and a closed position where the seal closes and seals the aperture.

A baffle assembly is mounted within the housing for deflecting and slowing propellant gasses produced when the propellant charge is ignited. The baffle assembly and the housing define an annular cavity for receiving the propellant gasses and sabot fragments. The baffle assembly includes a plurality of frustoconical rings for deflecting the propellant gasses. The opening in each of the rings is substantially coaxial with the projectile path to allow free passage of the projectile therethrough.

The muzzle brake and seal assembly includes at least one pressurized air inlet port to provide a means of pressurizing the interior of the housing when the valve seal is not in the fully closed position. An exhaust port provides a means of removing accumulated propellant gasses.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE PREFERRED EMBODIMENT

Figure 1:
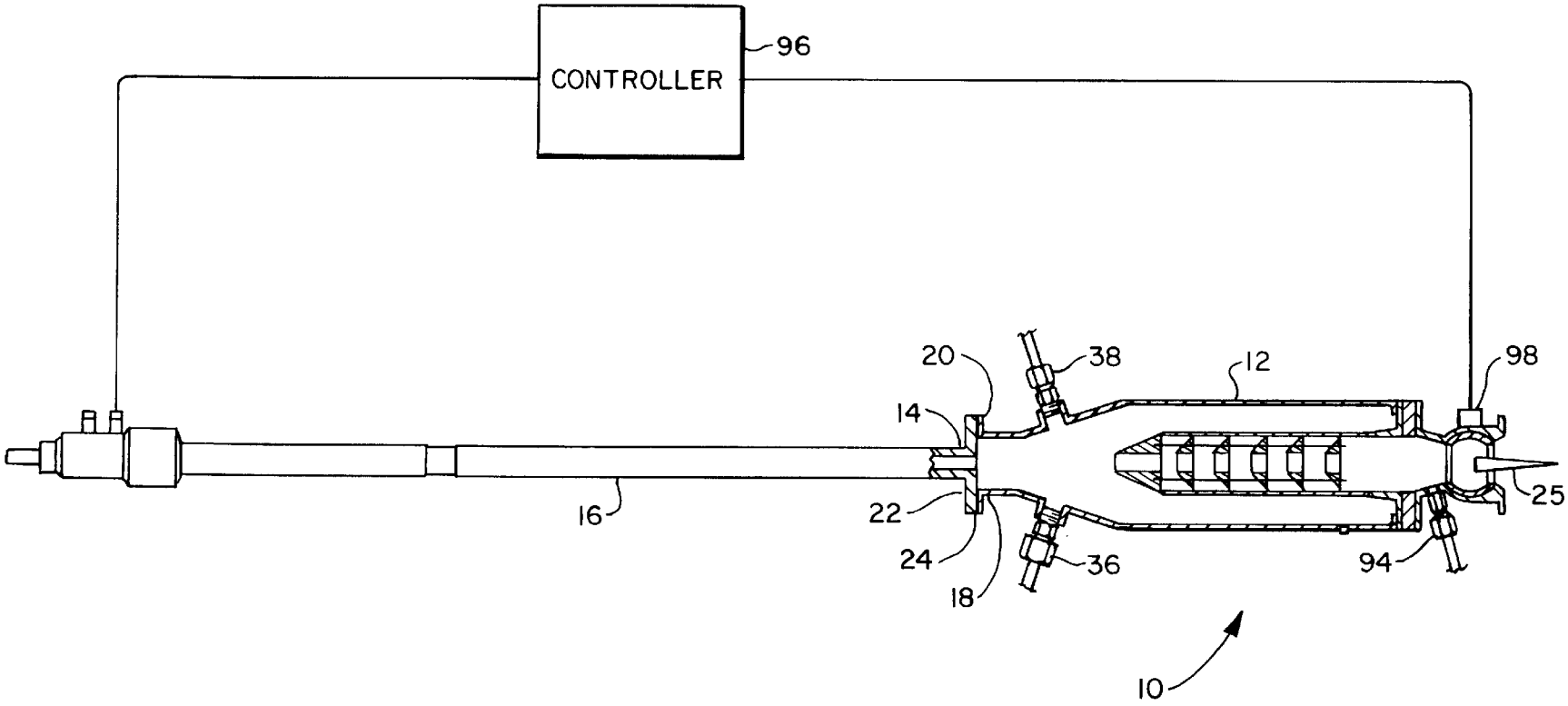
FIG. 1 is a cross-section view of a baffled muzzle brake and seal assembly in accordance with the present invention mounted to the breech and barrel assembly of a submerged gun.

With reference to the drawings wherein like numerals represent like parts throughout the several figures, a baffled muzzle brake and seal assembly 10 in accordance with the present invention comprises a muzzle brake chamber 12 mounted to the muzzle 14 of a submerged gun barrel 16. As shown in FIG. 1, the breech end 18 of the muzzle brake chamber 12 may comprise a flange 20 that is mounted to a flange 22 on the gun barrel 16. A seal 24, such as a gasket, prevents water entry between the flange of the muzzle brake chamber and the flange of the gun barrel. Alternatively, the muzzle brake chamber 12 may be mounted by other means known in the art. A projectile 25 is shown exiting muzzle brake chamber 12.

Figure 2:
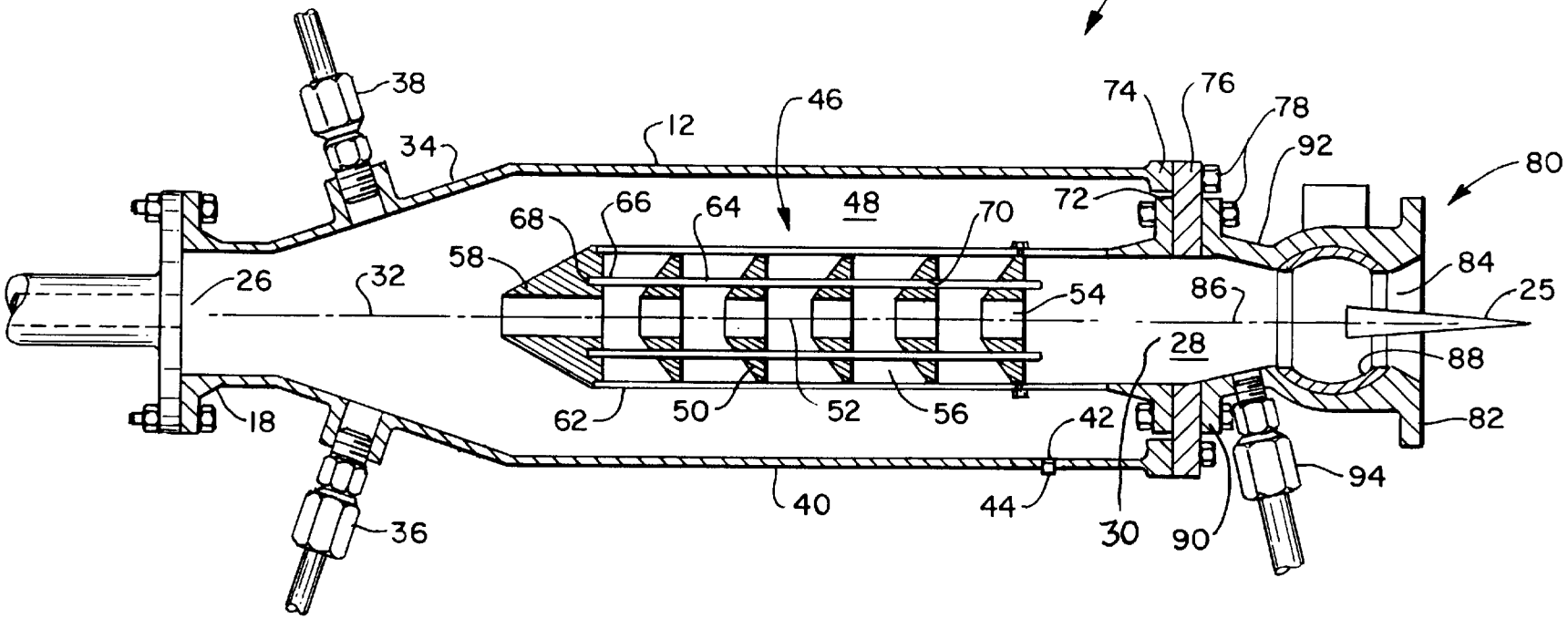
FIG. 2 is an enlarged cross-section view of the muzzle brake and seal assembly of FIG. 1.

With reference to FIG. 2, the muzzle brake chamber 12 includes a projectile entry port 26 in the breech end 18 and a projectile outlet port 28 in the muzzle end 30 that define an axial projectile path 32 through the chamber 12. The muzzle brake chamber 12 also includes a frustoconical transition section 34 that extends longitudinally from the breech end 18. The transition section 34 comprises an air inlet port 36 for receiving pressurized air from a pressurized air supply (not shown) and a gas outlet port 38 for discharging propellant gasses that accumulate in the chamber 12. The frustoconical shape of the transition section 34 provides a smooth transition from the relatively small diameter opening of the projectile entry port 26 to the relatively large diameter of the housing section 40 of the muzzle brake chamber 12. The smooth transition prevents localized loading on the exterior surface of the muzzle brake chamber 12 due to water pressure. The cylindrical housing section 40 has at least one drain 42 for removing water from the muzzle brake chamber. A plug 44 or other sealing apparatus is provided in the drain and the drain may be connected to an accumulator (not shown). The dimensions of the muzzle brake chamber 12 are selected such that there is sufficient volume for the accumulation of sabot fragments and for the deflection of propellant gasses, as described below. Sabot fragments can be removed by any of a variety of means well known in the art.

A baffle assembly 46 mounted within the housing section 40 and the interior surface of the housing section 40 define an annular cavity 48. The baffle assembly 46 includes a plurality of muffler deflectors having the shape of frustoconical rings 50, where the axis 52 of the opening 54 in each ring 50 is coaxial with the projectile path 32. The inside diameter of the opening 54 in the rings 50 is selected such that the projectile passes freely through the baffle assembly 46. The frustoconical shape of the rings 50 causes the propellant gasses that enter the chamber 12 to be deflected from the projectile path 32 into the annular cavity 48. The frustoconical shape also causes the propellant gasses to expand as they pass through the muffler exhaust ports 56 between the rings 50. Such expansion reduces the propellant gas pressure, thereby mitigating the pressure impulse imparted to the water. The first or primary ring 58 also serves to strip a sabot from the projectile as the projectile passes through ring 58. Since the velocity of the propellant gasses is greatest at the entrance of the baffle assembly 46 and since the primary ring 58 must withstand the impact force of both the propellant gasses and sabot fragments, the length of the primary ring 58 has been made greater than the length of the other rings 50 to provide additional mass.

The baffle assembly 46 also includes a plurality of support rods 62 and positioning rods 64 to mount the rings 50 together to form a single structure and to mount the baffle assembly to the chamber 12. The breech end 66 of each positioning rod 64 is received in a blind bore 68 in the muzzle end surface of the primary ring 58. Each positioning rod extends through and engages the inside surface of an axially extending bore 70 in the other rings 50 to mount them to the primary ring 58. Each other ring 50 is axially spaced from the primary ring 58 at a predetermined distance to provide the required deflection of the propellant gasses. The support rods 62 are mounted to the peripheral edge of each ring 50 and the muzzle end of the support rods are mounted to a ring-shaped flange 72 for connection to the muzzle brake chamber 12.

The muzzle end 30 of the chamber 12 comprises a flange 74 having a plurality of axially extended threaded openings. A disk-shaped mounting member 76 is mounted to flange 74 by bolts 78 that extend through an outer ring of openings in the mounting member 76 and threadably engage the openings in the flange 74. Alternatively, a plurality of nuts may threadably engage studs that extend longitudinally from the flange and through the openings in the mounting member. The mounting member 76 also has an inner ring of openings for receiving bolts 78 to mount flange 72 and a valve assembly 80.

Preferably, the valve assembly 80 comprises a pneumatic ball valve having a valve body 82 defining an aperture 84. The aperture 84 surrounds a projectile path 86 which is coaxial with the projectile path 32 of the chamber 12. The ball 88 of the valve is moveable between an open position, where no portion of the ball lies in the projectile path (as shown in FIG. 2), and a closed position, where the ball seals the aperture 84. The valve body 82 further comprises a flange portion 90 and an extension portion 92. The flange portion 90 has a plurality of openings for receiving bolts 78 to mount the valve assembly 80 to the mounting member 76. The extension portion 92 has an air inlet port 94 for receiving pressurized air from the pressurized air supply.

The ball 88 of the valve cycles between a fully open condition, to allow passage of the projectile, and a fully closed position, to seal the muzzle brake chamber 12 against the entry of water. As shown in FIG. 1, the valve controller 96 receives a signal from the gun firing mechanism (not shown) just prior to ignition of the propellant charge. The controller 96 transmits signal to valve actuator 98. Valve actuator 98 opens the valve 88 approximately 1 millisecond before the charge is detonated. The time delay between the valve 88 opening and munition 25 discharge is short to minimize the time period when water can enter the muzzle brake chamber 12. Pressurized air may be admitted into the muzzle brake chamber 12 and the valve assembly 80 via the air inlet ports 36, 94 to pressurize the muzzle brake chamber 12 above the ambient sea pressure whenever the valve 88 is not fully shut. This overpressure further impedes the entry of water into the muzzle brake chamber 12. Propellant gasses may also contribute to pressurization of the muzzle brake chamber 12. The gas outlet port 38 provides means for discharging the propellant gasses to an accumulator (not shown), thereby reducing excess pressure in the muzzle brake chamber 12 associated with the propellant gasses.

Obviously many modifications and variations of the present invention may become apparent in light of the above teachings. For example: the muffler deflectors may have a different shape or may be assembled in a different arrangement. Valve operators and valve types other than an pneumatically operated ball valve may be used provided that, when the valve is fully open, no valve components lie in the projectile path. In light of the above, it is therefore understood that within the scope of the appended claims, the invention may be practiced otherwise than as specifically described.

What is claimed is:

1. A barrel for an underwater firearm having a propellant charge and a projectile with a sabot, the barrel comprising:

a housing having breech and muzzle ends, the breech end being mounted to the firearm and having a projectile inlet port in said housing, the muzzle end having a projectile outlet port in said housing, the projectile inlet port and the projectile outlet port defining a first projectile path that is substantially coaxial with the axial bore of the firearm;

baffle means for deflecting and slowing propellant gasses produced when the propellant charge is ignited, the baffle means comprising a plurality of deflectors for deflecting the propellant gasses and being disposed within the housing wherein the baffle means and the housing define an annular cavity, and each of the deflectors comprises a frustoconical ring defining an opening having an axis that is substantially coaxial with the first projectile path; and valve means for selectively sealing the housing from entry of the water, the valve means defining an aperture and having a seal means for closing and opening the aperture, the valve means being mounted to the muzzle end of the housing, the aperture defining a second projectile path that is substantially coaxial with the first projectile path, the seal means being moveable between an open position wherein no portion of the valve is in the second projectile path and a closed position wherein the seal means seals the aperture.

2. The barrel of claim 1 wherein the deflectors comprise a plurality of axially spaced rings, each ring having a smaller outer diameter end and a larger outer diameter end, the smaller outer diameter end of each ring being oriented toward the breech end of the housing.

3. The barrel of claim 2 wherein the breech-most deflector is structured for stripping the sabot from the projectile as the projectile passes the breech-most deflector.

4. The barrel of claim 3 wherein the breech-most deflector has a greater mass than the other deflectors.

5. A barrel for an underwater firearm having a propellant charge and a projectile with a sabot, the barrel comprising:

a housing having breech and muzzle ends, the breech end being mounted to the firearm and having a projectile inlet port in said housing, the muzzle end having a projectile outlet port in said housing, the projectile inlet port and the projectile outlet port defining a first projectile path that is substantially coaxial with the axial bore of the firearm;

baffle means for deflecting and slowing propellant gasses produced when the propellant charge is ignited, the baffle means comprising a plurality of deflectors for deflecting the propellant gasses and being disposed within the housing wherein the baffle means and the housing define an annular cavity; and valve means for selectively sealing the housing from entry of the water, the valve means defining an aperture and having a seal means for closing and opening the aperture, the valve means being mounted to the muzzle end of the housing, the aperture defining a second projectile path that is substantially coaxial with the first projectile path, the seal means being moveable between an open position wherein no portion of the valve is in the second projectile path and a closed position wherein the seal means seals the aperture;

a first inlet means in fluid communication with the housing for supplying a flow of pressurized air; and an outlet means in fluid communication with the housing for exhausting propellant gasses produced when the propellant charge is ignited.

6. The barrel of claim 5 further comprising a second inlet means in fluid communication with the valve means for supplying a flow of pressurized air.

7. A barrel for an underwater firearm having a propellant charge and a projectile with a sabot, said barrel comprising:

a housing having breech and muzzle ends, the breech end being mounted to the muzzle end of said underwater firearm and comprising a projectile inlet port, the muzzle end of the housing comprising a projectile outlet port, the projectile inlet port and the projectile outlet port defining a first projectile path;

valve means mounted on the muzzle end of the housing for selectively sealing the housing from entry of the water, said valve means defining an aperture and including seal means for closing and opening the aperture, the aperture defining a second projectile path that is substantially coaxial with the first projectile path, the seal means being moveable between an open position wherein no portion of the seal means is in the second projectile path and a closed position wherein the seal means seals the aperture;

baffle means disposed within the housing for deflecting and slowing propellant gasses produced when the propellant charge is ignited; and a controller means for moving the seal means to the open position prior to ignition of the propellant charge.

8. The firearm of claim 7 wherein the controller means moves the seal means to the open position 1 millisecond before ignition of the propellant charge.

9. A barrel for an underwater firearm having a propellant charge and a projectile with a sabot, said barrel comprising:

a housing having breech and muzzle ends, the breech end being mounted to the muzzle end of said underwater firearm and comprising a projectile inlet port, the muzzle end of the housing comprising a projectile outlet port, the projectile inlet port and the projectile outlet port defining a first projectile path;

valve means mounted on the muzzle end of the housing for selectively sealing the housing from entry of the water; and a baffle means disposed within the housing for deflecting and slowing propellant gasses produced when the propellant charge is ignited, said baffle means comprising a plurality of frustoconical rings for deflecting the propellant gasses, each of the rings having a smaller outer diameter end and a larger outer diameter end and defining an opening having an axis that is substantially coaxial with the first projectile path, the smaller diameter end of each ring being oriented toward the breech end of the housing.

10. The firearm of claim 9 wherein the baffle means further comprises a plurality of spacer rods and wherein the frustoconical rings comprise a primary ring and a plurality of secondary rings, wherein the primary and secondary rings are mounted to the spacer rods in axially spaced relationship and, the spacer rods are joined to the housing.

11. The firearm of claim 10 wherein the primary ring strips the sabot from the projectile as the projectile passes the primary deflector.

12. The firearm of claim 9 wherein the baffle means further comprises:

a plurality of support rods, each having a muzzle end portion, said rods supporting the frustoconical rings within the housing; and a ring-shaped flange mounted to the housing and to the support rods such that the support rods are mounted around the ring-shaped flange at the muzzle end portion of each rod such that the support rods extend axially through the housing.

* * * * *